United States Patent [19]

Frondorf

[11] 3,938,934

[45] Feb. 17, 1976

[54] FUEL ECONOMIZER PROCESS AND APPARATUS

[75] Inventor: William A. Frondorf, Rocky River, Ohio

[73] Assignee: SCM Corporation, New York, N.Y.

[22] Filed: Nov. 8, 1974

[21] Appl. No.: 521,974

[52] U.S. Cl. ..... 431/11; 122/DIG. 2; 165/122; 431/211

[51] Int. Cl.[2] ..... F23D 11/44

[58] Field of Search ..... 431/2, 11, 210, 211; 165/122; 122/DIG. 2

[56] References Cited

UNITED STATES PATENTS 3,315,733 4/1967 Jacobs ..... 165/122 X

FOREIGN PATENTS OR APPLICATIONS 747,055 3/1956 United Kingdom..... 122/DIG. 2

*Primary Examiner*—Edward G. Favors
*Attorney, Agent, or Firm*—Richard H. Thomas

[57] ABSTRACT

Combustion air feed to a fuel burner is warmed with water otherwise destined for evaporative cooling in a cooling tower or spray pond; then the resulting warmed air is sent to combustion while the resulting cooled water is further cooled by evaporation for recycle use.

4 Claims, 1 Drawing Figure

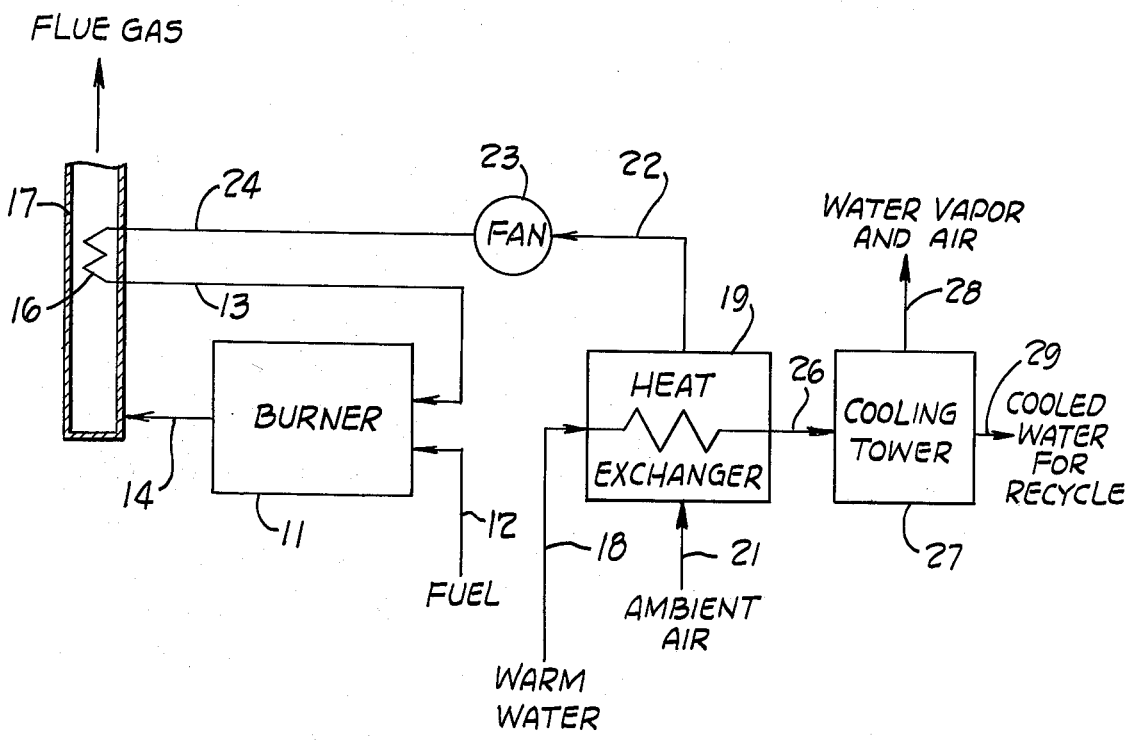
FLUE GAS
17
24
23
22
FAN
WATER VAPOR AND AIR
28
16
13
19
HEAT
EXCHANGER
26
COOLING TOWER
29
COOLED WATER FOR RECYCLE
BURNER
14
11
12
FUEL
18
21
AMBIENT AIR
27
WARM WATER

FUEL ECONOMIZER PROCESS AND APPARATUS

This invention relates to heating cool combustion air feed to a fuel burner at an installation having a source of warm water to be cooled for recycle use by evaporative means such as a water cooling tower or a spray pond.

Water to a cooling tower often is as high as 125°–135°F. It is conventionally cooled towards the wet-bulb temperature of the atmosphere. Combustion air to a fuel burner such as a boiler frequently is fed to the boiler without preheating, although flue gas heat exchange with such air is often practiced at large installations. Fresh combustion air feed often can be quite cool in wintertime. The instant invention unites in heat exchange the evaporative cooling of warm water to be further cooled for recycle use with the warming of air fed to a fuel burner. Both such items of equipment are frequently found at industrial plants. Fuel economy of a percent or so thus is possible at the expense of a heat exchanger installation for the reusable warm water and the combustion air, while also cutting down on the cooling load of the evaporative cooler.

In one aspect, this invention comprises a process for heating such cool combustion air fed to a fuel burner at an installation having a source of warm water to be cooled for recycle use by exchanging heat from said source to said air preparatory to recycling said water, then dispatching the resulting warmed air to said burner. The warmed water output from said exchange is then further cooled by evaporation as by a cooling tower or spray pond.

The instant fuel economizer apparatus comprises a fuel burner, means for supplying combustion air thereto (often a fan and accompanying ductwork), an indirect heat exchanger for exchanging heat to said air from a stream of reusable warm water, and a cooling tower for receiving and further cooling said water after said heat exchanging.

The drawing is a flow diagram showing how one way this invention can be practiced. Fuel burner 11, a boiler, is fed with fuel such as petroleum fuel oil through line 12 and prewarmed combustion air therefor through line 13. The fuel is burned and flue gas goes out stack connector 14, passes through air preheater 16, and exhausts through stack 17.

Warm water from condensers, eg. on distillation columns, at the installation passes through line 18 into indirect heat exchanger 19, the water passing through tubes such as fin tubes. This water warms ambient air entering the shell of heat exchanger 18 by means of line 21 and being withdrawn by line 22. Fan 23 takes warmed air suction from line 22. This air is blown through line 24, air preheater 16 for further heating, then through line 13 into burner 11. Alternatively, line 24 can be connected directly to line 13, avoiding air preheater 16.

Water from the heat exchanger passes out line 26 into cooling tower 27 where it is further cooled by evaporation with vapors ascending duct 28, and cool water for recycle use is withdrawn from the system through line 29.

While the combustion air can be put into direct heat exchange with the warm water, this has the disadvantage of humidifying the combustion air, which is often undesirable. The materials of construction are conventional as is the design of the individual pieces of equipment. Instrumentation, valves, fittings, and ductwork also are conventional and are employed where necessary or desirable.

I claim:

1. A process for heating cool combustion air feed to a fuel burner at an installation having a source providing a stream of warm water to be cooled for recycle use and means for evaporative cooling of said warm water, the improvement for reducing the load on said evaporative cooling means and for utilizing heat in said warm water stream comprising:

indirectly exchanging heat from said stream of warm water to said air, and dispatching resulting warmed air to said burner, said heat exchange from said stream of warm water to said air taking place prior to evaporative cooling of the warm water.

2. The process of claim 1 wherein the evaporative cooling takes place in a cooling tower.

3. Fuel economizer apparatus for an installation which comprises a fuel burner, means for supplying combustion air to said burner, a source providing a stream of reusable warm water and an evaporative cooler for receiving and cooling said water; the improvement for reducing the load on said evaporative cooler and utilizing heat in said warm water stream comprising an indirect heat exchanger for exchanging heat from said warm water to said combustion air, said heat exchanger being positioned in the flow path of said stream of warm water upstream of the evaporative cooler.

4. The apparatus of claim 3 wherein said evaporative cooler is a cooling tower.

* * * * *